US005511402A

United States Patent [19]

Kauffman

[11] Patent Number: 5,511,402

[45] Date of Patent: Apr. 30, 1996

[54] OPTIMIZING CONTROLLER

[76] Inventor: Kenneth A. Kauffman, RR 34, Box 13 Pisgah Rd., York, Pa. 17406

[21] Appl. No.: 358,014

[22] Filed: Dec. 16, 1994

[51] Int. Cl.[6] ..... B21C 51/00; B21D 7/024

[52] U.S. Cl. ..... 72/14.8; 72/294; 72/307; 364/474.07

[58] Field of Search ..... 72/307, 294, 7, 72/14, 338, 339, 14.8; 364/474.07

[56] References Cited

U.S. PATENT DOCUMENTS

| | | | |
|---|---|---|---|
| 1,371,288 | 3/1921 | Walhaupter | 29/417 |
| 1,672,861 | 6/1928 | Smith | 72/307 |
| 3,563,283 | 2/1971 | Tufektshiev | 72/307 |
| 4,161,110 | 7/1979 | Ritter | 72/307 |
| 4,486,840 | 12/1984 | Klein et al. | 72/21 |
| 5,135,522 | 5/1994 | Kauffman | 72/307 |
| 5,319,918 | 6/1994 | Bauer et al. | 72/7 |
| 5,355,708 | 10/1994 | Kauffman | 72/294 |

FOREIGN PATENT DOCUMENTS

| | | | |
|---|---|---|---|
| 1324711 | 7/1987 | U.S.S.R. | 72/294 |

*Primary Examiner*—Daniel C. Crane
*Attorney, Agent, or Firm*—Samuel M. Learned Jr.

[57] ABSTRACT

An optimizing controller for a straight rod stock processing stirrup bender which provides a production method enabling a combination of bent rod stock profiles in multiple counts to be delivered from each individual infed straight rod stock bar, whereby bent rod stock piece output is optimized through such an output combination so as to most efficiently utilize the available stock from each such infed straight rod stock bar and thereby to consistently minimize the tail piece wastage consistent with the stirrup bender tail piece handling capabilities, also thereby substantially reducing labor and waste and handling costs per ton which are otherwise normally associated with the processing of straight rod stock lengths through a stirrup bender.

8 Claims, 12 Drawing Sheets

32
96
78
100
106
18

Fig. 14 (after 12 bars are run)
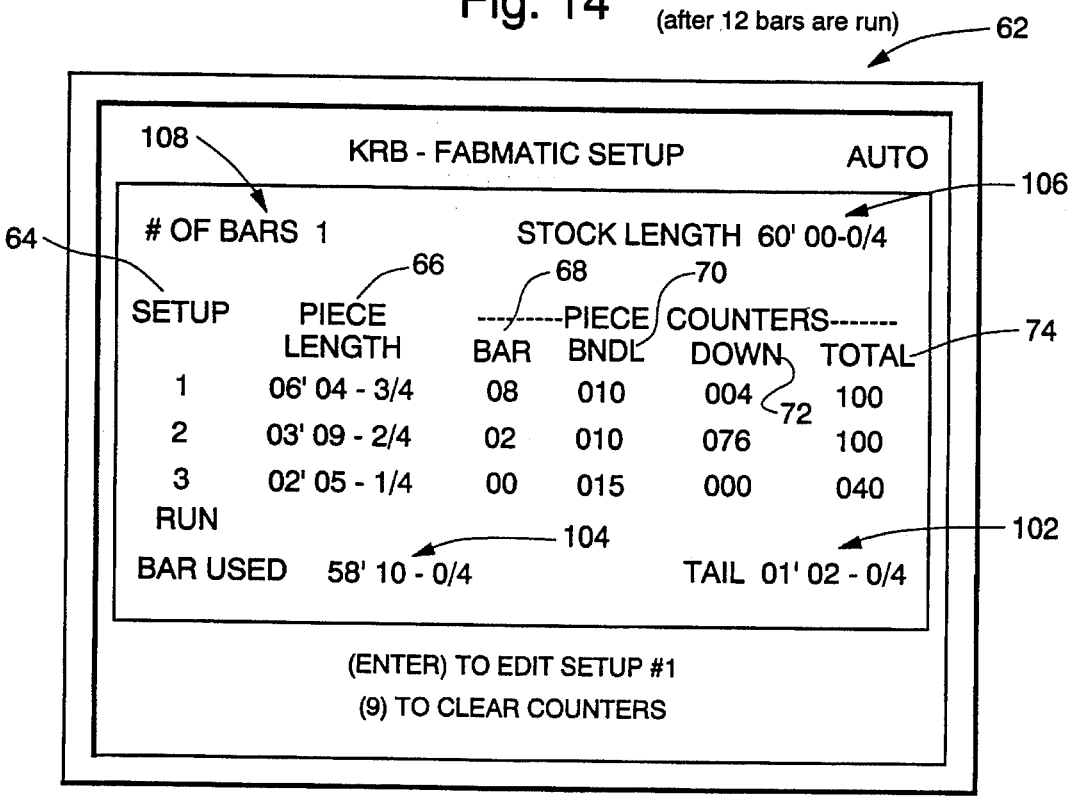
Fig. 15
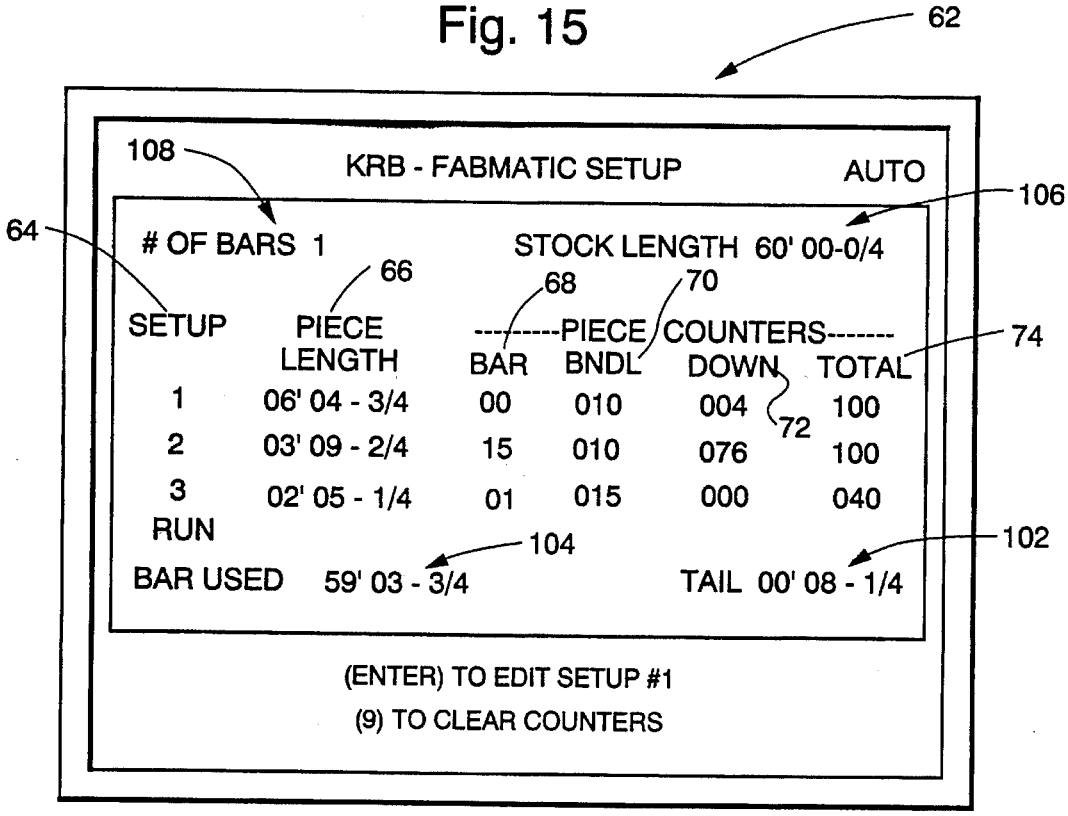

Fig. 16 (after 5 bars have been run)
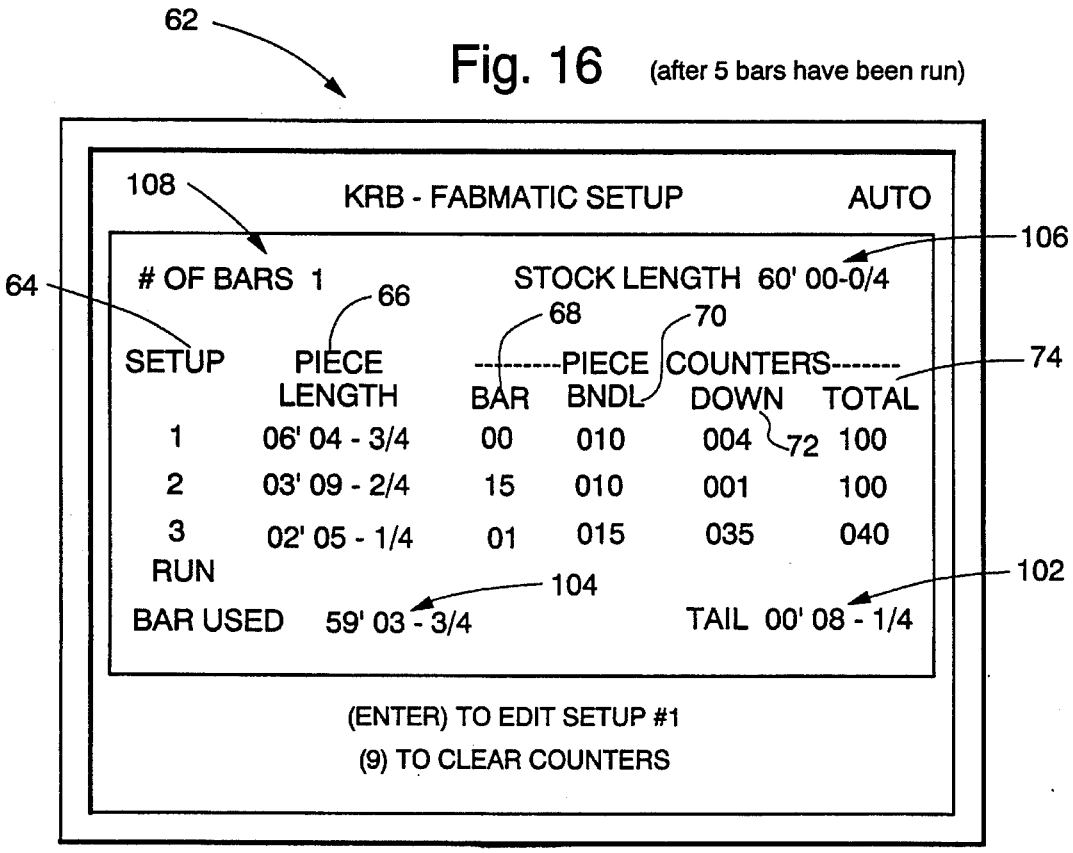
Fig. 17
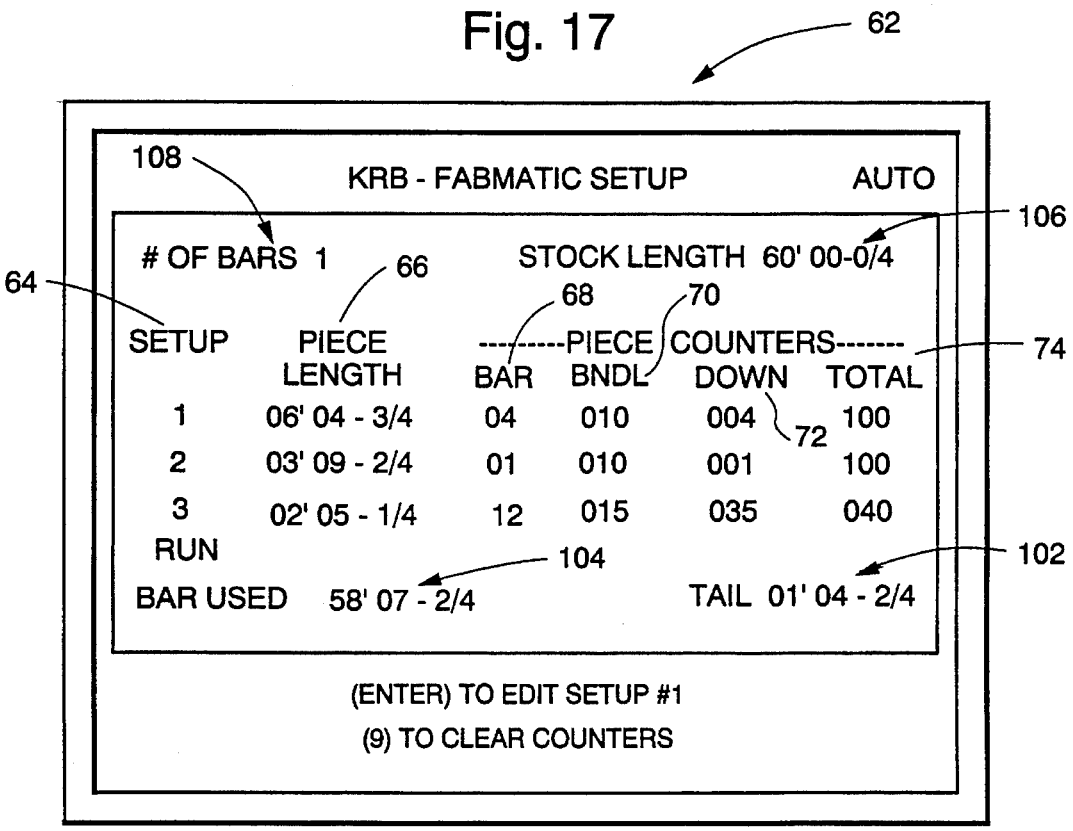

Fig. 18 (after 1 bar has been run)
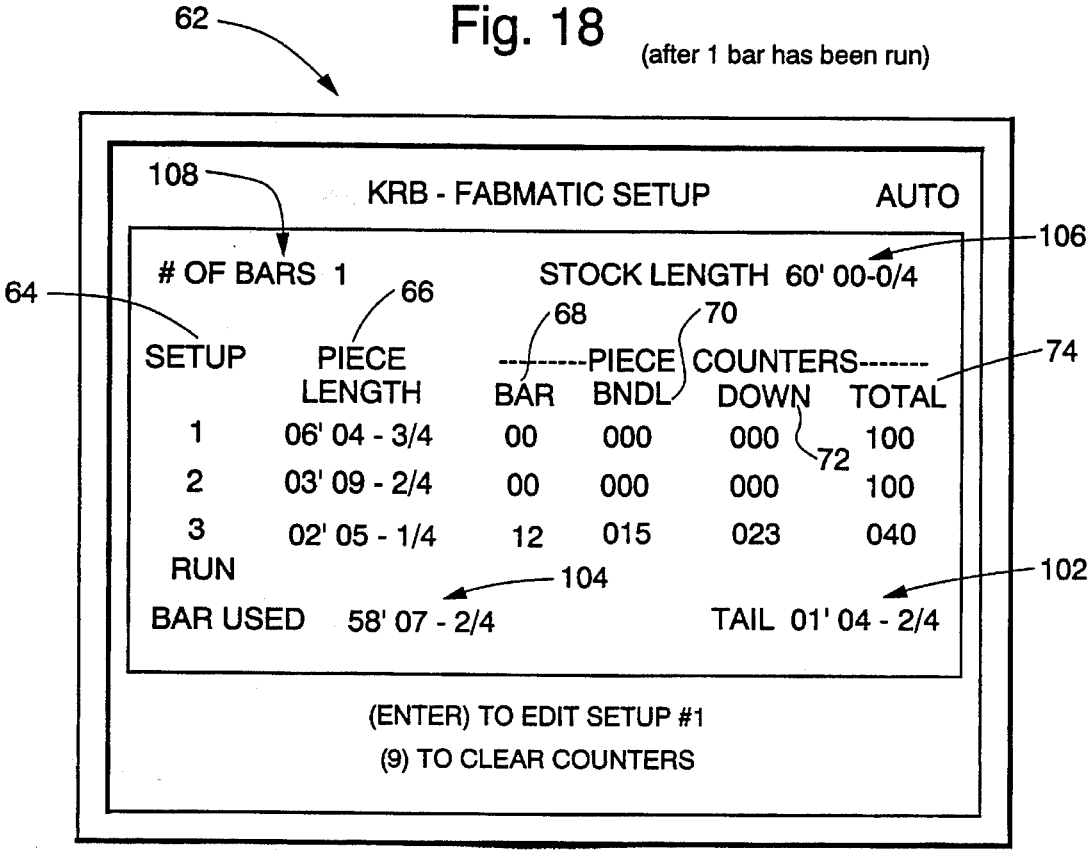
FIG. 19
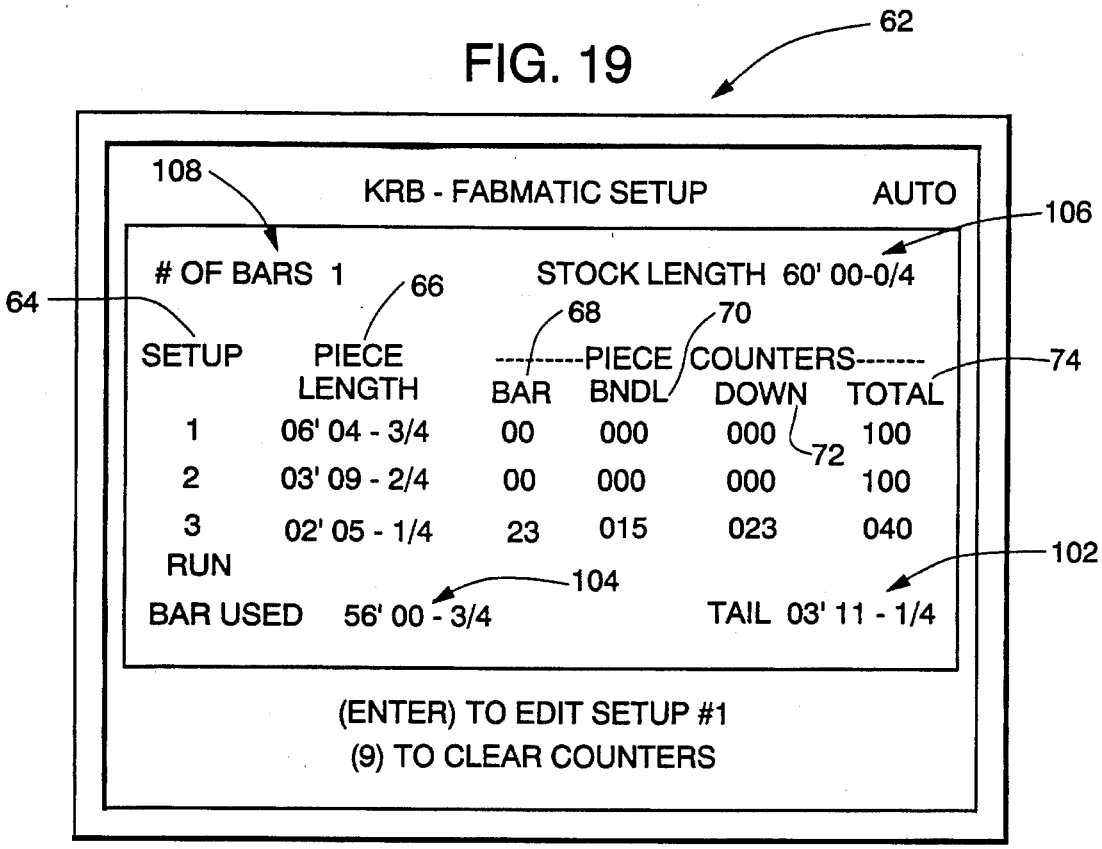

(after 1 bar has been run)

OPTIMIZING CONTROLLER

BACKGROUND OF THE INVENTION

The present invention relates to an optimizing controller to be delayed in combination with a straight rod stock processing stirrup bender of that type taught in Applicant's co-pending application Ser. No. 08/170,611 which was filed on Dec. 20, 1993, now U.S. Pat. No. 5,355,708, for a STRAIGHT ROD STOCK PROCESSOR, wherein the instant invention further enhances the operational efficiencies and utility of such a stirrup bender by enabling a combination of bent rod stock profiles in multiple counts to be produced from an individual infed straight rod stock bar so that the minimum dimension of tail piece wastage consistent with the tail piece handling capability of the stirrup bender is consistently realized.

In Applicant's above-identified co-pending Application, the machine teaching thereof embodies the incorporation of a set of secondary rod stock compression rollers positioned just forward of the stirrup bender head on the infeed side thereof so that essentially the entire length of an infed rod stock piece may be thereby positioned and controlled in delivery to the stirrup bender head for processing into bent rod stock pieces. This incorporation of a set of secondary rod stock compression rollers enables the reduction of tail piece wastage from each individually infed straight rod stock bar from something on the order of five-feet to less than one-foot. However, if consumption of an infed bar in the production of bent rod stock pieces is such that the tail piece remainder is such that there is not sufficient bar remaining to produce another piece but results in a tail length greater than one-foot, then production of multiples of that particular profile, and consumption of an infed straight rod stock bar in a plurality of linear dimensional requirement multiples for producing nothing but that one particular profile per se during the machine run of the individual infed straight rod stock bar therethrough, does not enable full realization of the machine capability for reducing the length of tail piece wastage to a minimum. On the other hand, if operational control of the straight rod stock processing stirrup bender in the production of bent rod stock pieces can be managed to combine multiples of different bend profiles having different linear dimensional requirement which are put together in such a way so as to make the most efficient utilization in consumption of the total linear dimension of the infed straight rod stock bar in consistently approaching a tail piece wastage in the vicinity of one-foot or so, then utilization of the straight rod stock processing stirrup bender is thereby consistently optimized and tail piece wastage consistently minimized, which are those capabilities provided by the optimizing controller teaching and method hereof.

Various bending machine control apparatus in the prior art have taught means whereby a more efficient production capability is realized from the bending machine, and wastage under coincidentally optimal production circumstances is minimized. Such bending machine and control combinations representatively include Applicant's U.S. Pat. No. 5,315,522 dated May 24, 1994, for a TABLE BENDER CONTROLLER, as well as the teaching by Bauer et al in U.S. Pat. No. 5,319,918 dated Jun. 14, 1994, in which there is disclosed an automated method for the customized making of horseshoes. On the larger production scale, U.S. Pat. No. 4,486,840 to Klein et al dated Dec. 4, 1984, provides for an automated control on a press brake for the selection of various gauge and ram positions which allow for both such variables to act in producing bends when forming materials with different flange lengths and angles.

None of the foregoing machines, however, nor the control means employed respectively in combination therewith, as does the machine and control combination of the instant invention and the method provided thereby, enable the production of output pieces in bend profile and count combinations which when processing a single piece of input stock for conversion allows for a designed optimization of production circumstances thereby minimizing the remainder or tail wastage to a level which is consistent with the handling and processing capabilities of the production machine, so as to in turn consistently optimize production and minimize wastage.

SUMMARY OF THE INVENTION

It is the principal object of the present invention to provide an optimizing controller to be used in combination with a straight rod stock processing stirrup bender whereby a method of production enabling the optimized output delivery of different and respectively multiple bend profile pieces from individual infed straight rod stock bars results in consistently minimizing the resultant tail piece waste from each bar.

It is also an object of the present invention to provide an optimizing controller the use of which greatly enhances both operator and machine production efficiencies in consistently delivering commercially acceptable output product.

A further object of the present invention is to provide an optimizing controller which enables a straight rod stock processing stirrup bending machine output capability equivalent to the more complicated and expensive fully automated stirrup bending machines, but at substantially lower capital and operating costs.

It is another object of the present invention to provide an optimizing controller which is adapted to be retrofit installable upon and utilized with a typical manually fed straight rod stock processing stirrup bender.

The foregoing, and other objects hereof, will be readily evident upon a study of the following specification and accompanying drawings comprising a part thereof.

BRIEF DESCRIPTION OF THE DRAWINGS

FIG. 14 is the optimizing controller run screen display showing the production counts after 12 pieces of input stock have been run for optimized production running of the first and second production piece profiles.

FIG. 15 is the optimized controller run screen display showing the count combination for continued optimized production running of the second and third production piece profiles in order to operate at continued ongoing overall minimized tail piece wastage.

FIG. 16 is the optimizing controller run screen display showing the production counts after 5 pieces of input stock have been run for optimized production running of the second and third production piece profiles.

FIG. 17 is the optimized controller run screen display showing the count combination for continued optimized production running of the third production piece profile and completion production running of the first and second production piece profiles in order to operate at continued ongoing overall minimized tail piece wastage.

FIG. 18 is the optimizing controller run screen display showing the production counts after 1 piece of input stock has been run for continued optimized production running of the third production piece profile and completed production running of the first and second production piece profiles.

FIG. 19 is the optimizing controller run screen display showing the count for production running completion of the third piece profile.

DETAILED DESCRIPTION OF THE INVENTION

Figure 1:
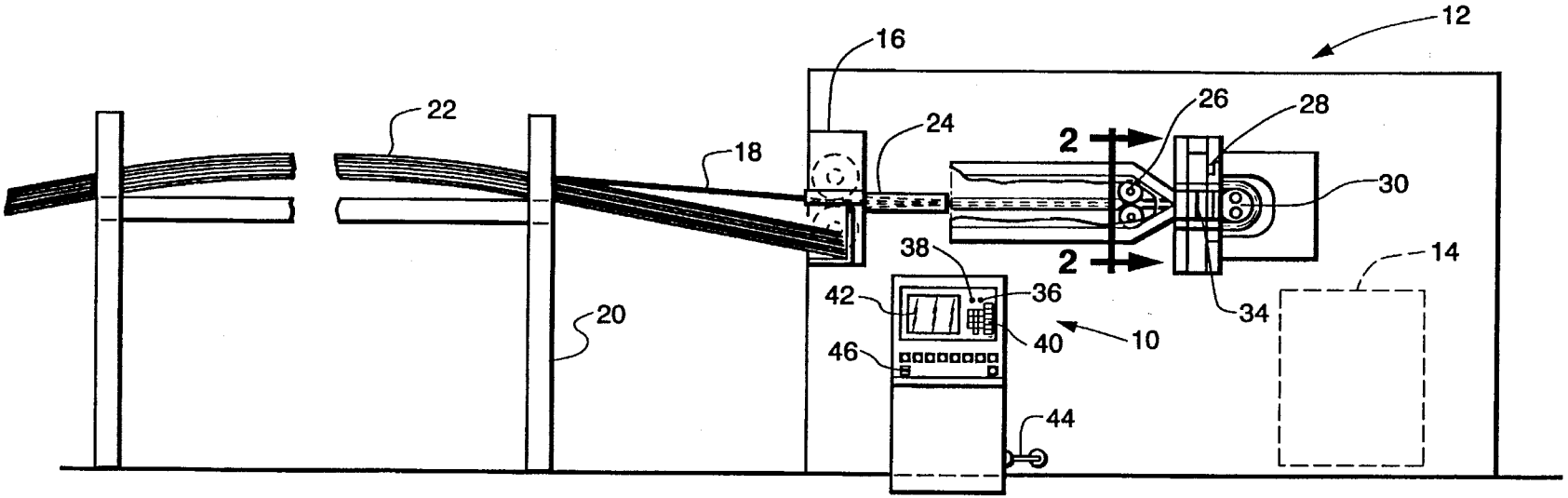
FIG. 1 is a simplified side elevation view of the optimizing controller of instant invention shown in installed combination with an exemplary straight rod stock processing stirrup bender.
Figure 2B:
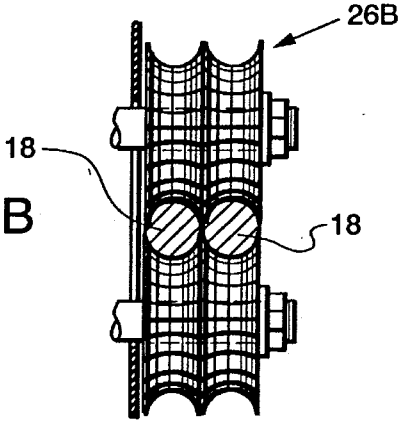
FIG. 2B is a view similar to that as shown in FIG. 2A, but in this case is an enlarged end elevation view of a replacement set of two-up secondary rod stock compression rollers.
Figure 2A:
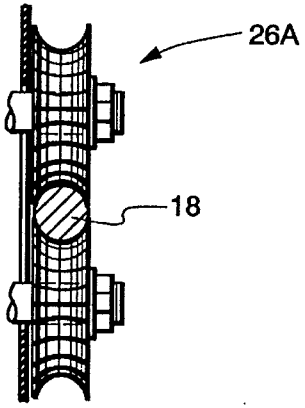
FIG. 2A is an enlarged end elevation view of the set of secondary rod stock compression rollers, as shown in FIG. 1 and seen along the line 2—2 thereof.
Figure 3:
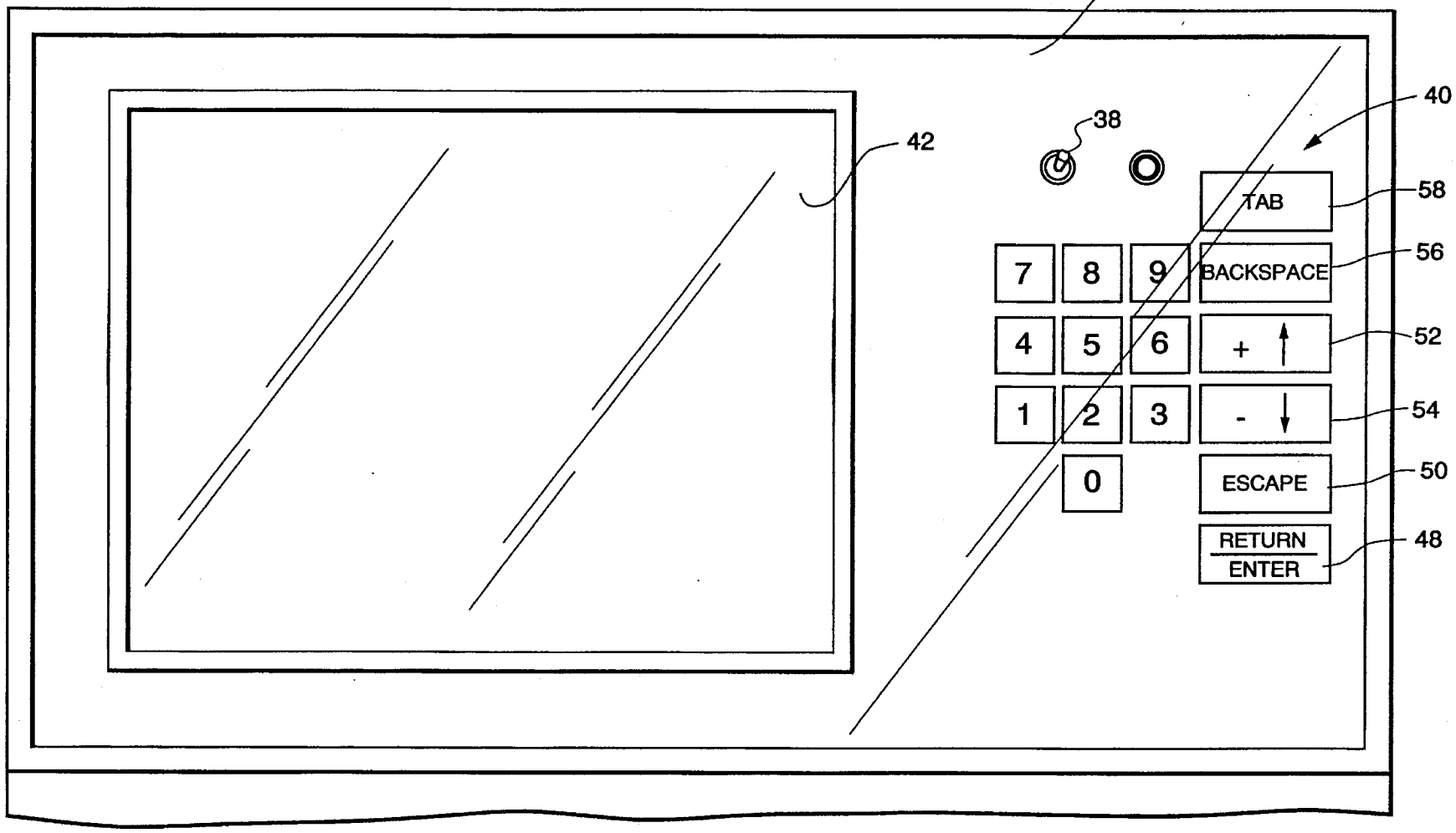
FIG. 3 is an enlarged front elevation view of the optimizing controller keyboard and screen as shown in FIG. 1.

Referring to FIG. 1, the optimizing controller 10 of present invention is shown in integrated electrical control connection to an exemplary straight rod stock processing stirrup bender 12 having a motor 14 to power the various stirrup bender operational stations, being the rod stock loader 16 which feeds straight rod stock bars 18 from a rod stock rack 20 containing a bundle of bars 22 into the infeed guide rails 24 for positive pick-up and delivery by the set of secondary rod stock compression rollers 26, through the shear station 28, and into the bender head 30 for processing into bent rod product. As shown in FIGS. 2A and 2B, the secondary rod stock compression rollers may be a single set 26A of such rollers as shown in FIG. 2A and deliver a single infed straight rod stock bar 18 one-up at a time for processing, or as shown in FIG. 2B they may be a replacement set 26B of two-up secondary rod stock compression rollers and effect a delivery infeeding of two straight rod stock bars 18 at a time for processing. Whether the straight rod stock bars 18 are infed to the stirrup bender 12 one-up or two-up at a time would depend upon a number of considerations such as the bar thickness, handling characteristics of the bar stock in bending, the run length, and factors of this nature. In any event, in the case of the exemplary straight rod stock processing stirrup bender 12 under instant consideration the minimum lineal length of tail piece wastage 32 from each piece of infed straight rod stock bar 18 is that distance between the set of secondary rod stock compression rollers 26 and the shear station 28 shear blade 34, which is more specifically eight-inches, and which minimum lineal length in this exemplary case represents the tail piece wastage 32 dimension to be optimally achieved in combining bent rod stock profiles in multiple counts from each individual infed straight rod stock bar 18 in order to most advantageously employ the optimizing controller 10 by the method hereof in consistently minimizing the tail piece wastage 32 consistent with the stirrup bender 12 tail piece dimensional handling capabilities. It is to be understood that the above-recited dimension for tail piece wastage 32 is exemplary only to the specific stirrup bender 12 under immediate exemplary consideration, and may be of a greater or lesser linear dimension depending on that which is consistent with the tail piece handling capabilities of the particular stirrup bender being employed in combination with the optimizing controller 10. That is, it is to be understood that the dimensional optimization of tail piece wastage 32 is relative to the tail piece handling capabilities of the stirrup bender with which the optimizing controller is used.

Referring now to the enlarged front elevation view of the optimizing controller 10 computer control console 36 with a power-on switch 38, input function keys 40, and the screen 42. The computer console 36 input function keys 40 are typical and explained thus. The optimizing controller 10 is powered up through the integrated circuitry of cable conduit 44 when the main controller console power-on switch 46 as shown in FIG. 1 is activated, which also energizes the motor 14. The computer control console 36 is powered up by activation of the power-on switch 38, which also illuminates the screen 42. With the controller 10 and the console 36 thus activated, and when the screen 42 has cleared the controller 10 is then ready for optimizing use. An initial pressing of the enter/return key 48 enables an operator to access for selection the operational mode within which he wants to work and the escape key 50 enables him to exit the selected mode of operation. The plus key 52 and the minus key 54 respectively enable the operator to either increase or decrease bend functions when setting up or trimming a bend function to be executed by the stirrup bender 12. The backspace key 56 enables the operator to backspace within the operational mode, and the tab key 58 enables one to sequentially tab through the individual bend profiles and bend instructions for a particular set of bend profile combinations during the actual operational use employment of the controller 10 in accomplishing optimized rod stock bending by consistently minimizing the tail piece wastage 32 consistent with the particular stirrup bender 12 tail piece handling capabilities. The numbered keys 0 through 9 enable the operator to enter various elements of data in a selected operational mode, and in particular the bend profile data for the respective bends and the multiple count combinations when in the manual setup mode.

Turning now to a consideration of the specific methodology for utilizing the optimizing controller 10, wherein for purposes of illustrative example and explanation only it is to be understood that the lengths of straight rod stock bar 18 to be run are consistently 60-feet, and that the exemplary bend shape profiles and run lengths thereof are typical of those encountered in normal production operations. It is also to be understood that for practical illustrative purposes only three different consecutively produced bend profile shapes are discussed, wherein it is further to be understood that in a typically normal shift or day's production schedule the numbers of pieces and count combinations herein illustrated and discussed for exemplary illustration in achieving optimization by most efficiently utilizing the available stock from each infed straight rod stock bar 18 represents only a small portion of that actual production which would be achieved on a continuing shift or day's production schedule, and that straight rod stock bar 18 lengths of other than 60-feet can and may be run and that the consistent use of 60-foot lengths herein is for ease and the purpose of exemplary illustration and description only.

Figure 4:
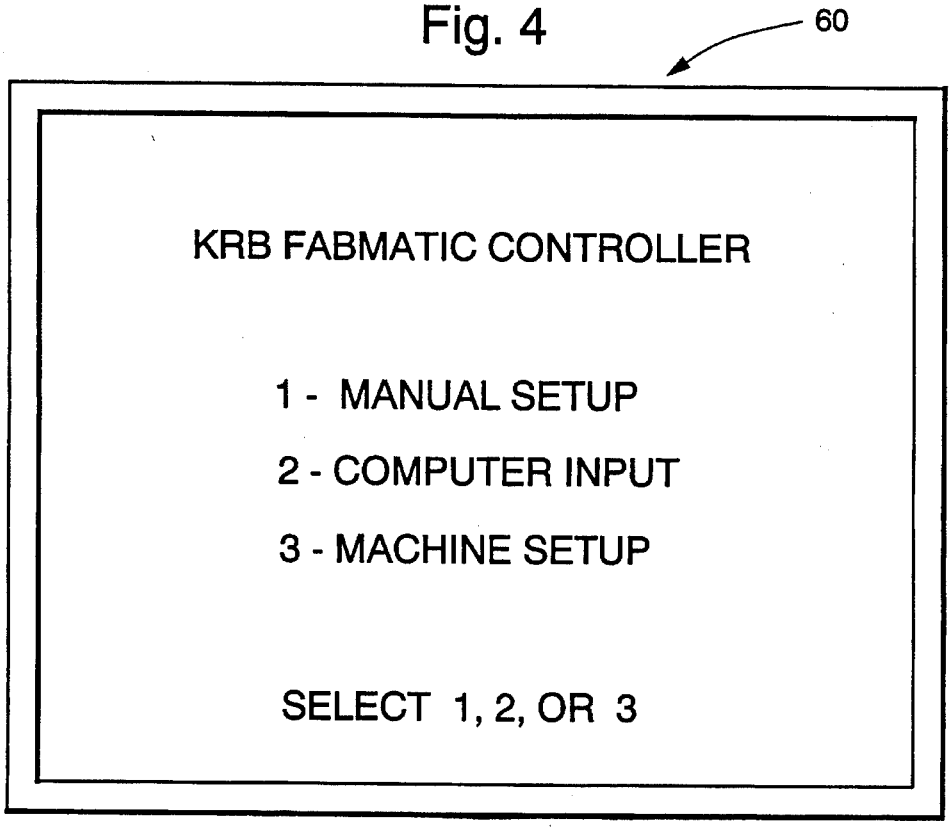
FIG. 4 is the optimizing controller screen display for selecting a mode of input function.
Figure 5:
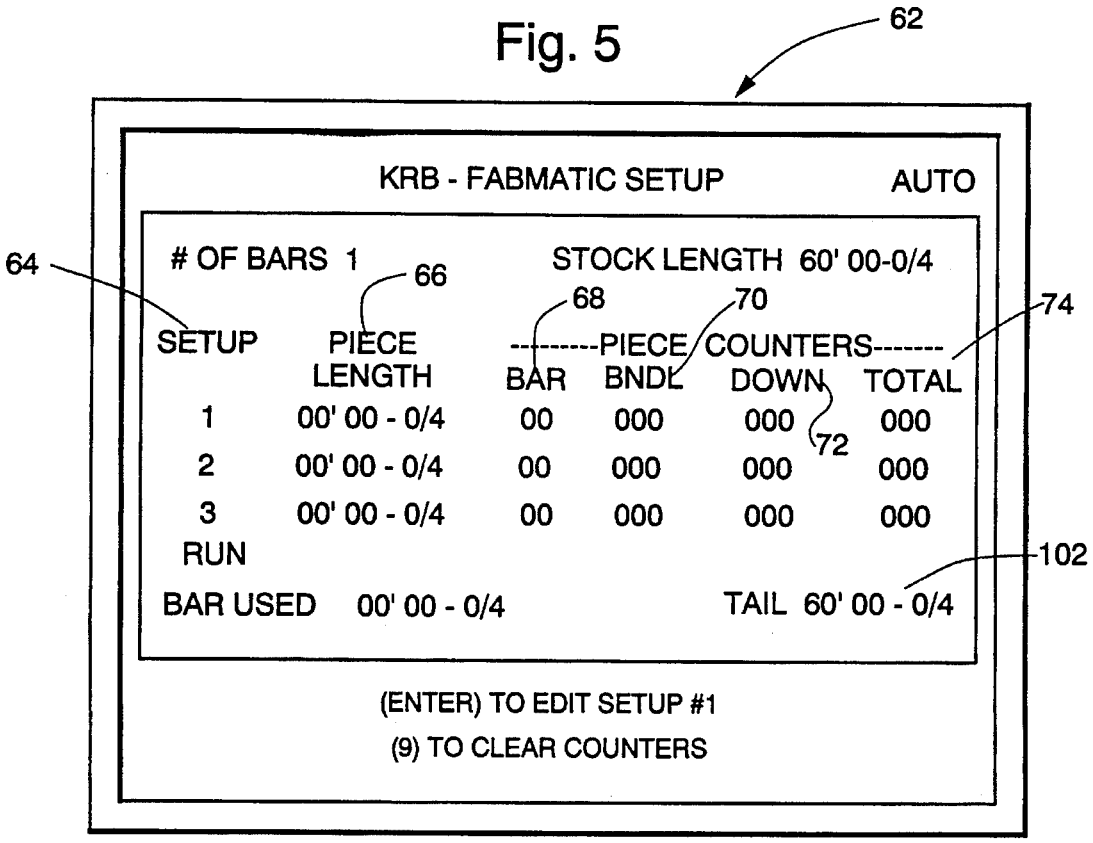
FIG. 5 is the optimizing controller screen display for the manual setup mode of input function.

Considering now operational setup of the controller 10 for optimized production, wherein FIG. 4 illustrates the operational mode selection screen 60 which comes up when the power-on switch 38 is activated and the screen 42 clears, which is the start up screen for selecting the mode of input function in order to effect optimized control of the tail piece wastage 32. In this exemplary operational instance, since the stirrup bender 12 is to be run by operator input at the stirrup bender 12 floor location, which is the manual setup mode, the operator would first depress the number 1 input function key 40 and then press the enter key 48 in order to access the manual setup mode which would then present the run screen 62 setup mode display as shown in FIG. 5. In the alternative, however, if the setup was to be downloaded from a house computer, then the number 2 input function key 40 would be depressed followed by a pressing of the enter key 48 in order to access the computer input setup mode. In addition to computer download setup in order to effect optimized control of the tail piece wastage 32, the number 2 computer input mode would also enable the optimization of the production schedule combinations with operational conditions.

Figure 8:
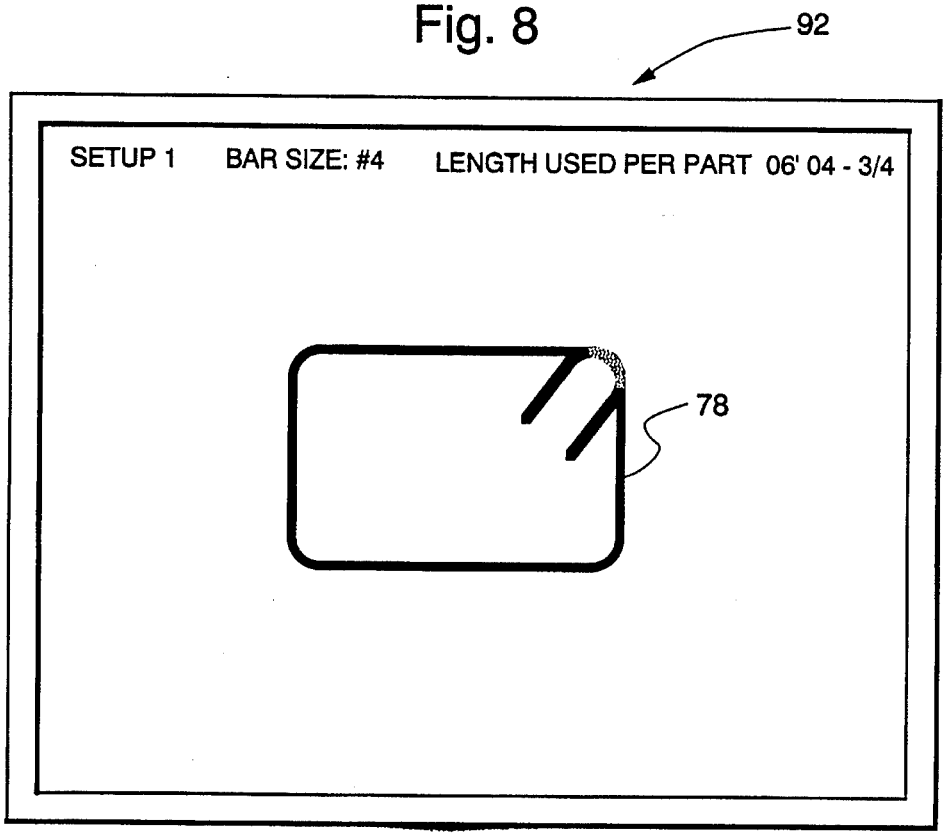
FIG. 8 is the optimizing controller screen display showing a profile projection of the shape of the first production piece setup.

Directing attention now to FIG. 5 and the various components of operational input data necessary for effecting production piece runs in the optimized control manner. As indicated by the run setup mode screen 62, operation of the stirrup bender 12 is automatic with an infeed in this exemplary case of one bar at a time to be run, and the stock length of each bar to be run 60-feet. The setup column 64 numbered 1 through 3 identifies each production piece run data line respectively corresponding thereto first being the piece length which is that uniformily incremental portion of the straight rod stock bar 18 length to be consumed in the production of each piece to be made, secondly the bar 68 which is the count of the number of each such production pieces to be made from each infed straight rod stock bar 18, next the bundle 70 which is the count of the number of production pieces which are to be bundled together as they come off the stirrup bender 12 delivery, and then the down 72 and total 74 counts wherein the down count 72 is the number of remaining production pieces of the total count 74 of that particular production piece setup 64 to be made during production running and the total count 74 is the total number of production pieces to be run in that particular production piece setup 64 order. The bar used is the total lineal dimension of each straight rod stock bar 18, in this exemplary case being of a 60-foot bar, consumed in making the number of production pieces to be fabricated from each such bar 18, and the tail is the lineal dimension of tail piece wastage 32 remaining from each such bar 18 when the optimizing controller 10 is set for optimized production running to minimize tail piece wastage 32 consistent with the tail piece handling capabilities of the particular stirrup bender 12 with which said controller 10 is being employed. As indicated at the bottom of the run setup mode screen 62, the operator depresses the enter key 48 to access the first production piece setup screen 76 for entering data to effect optimized automatic fabrication of the first production piece 78, the profile of which is as shown in FIG. 8.

Figure 6:
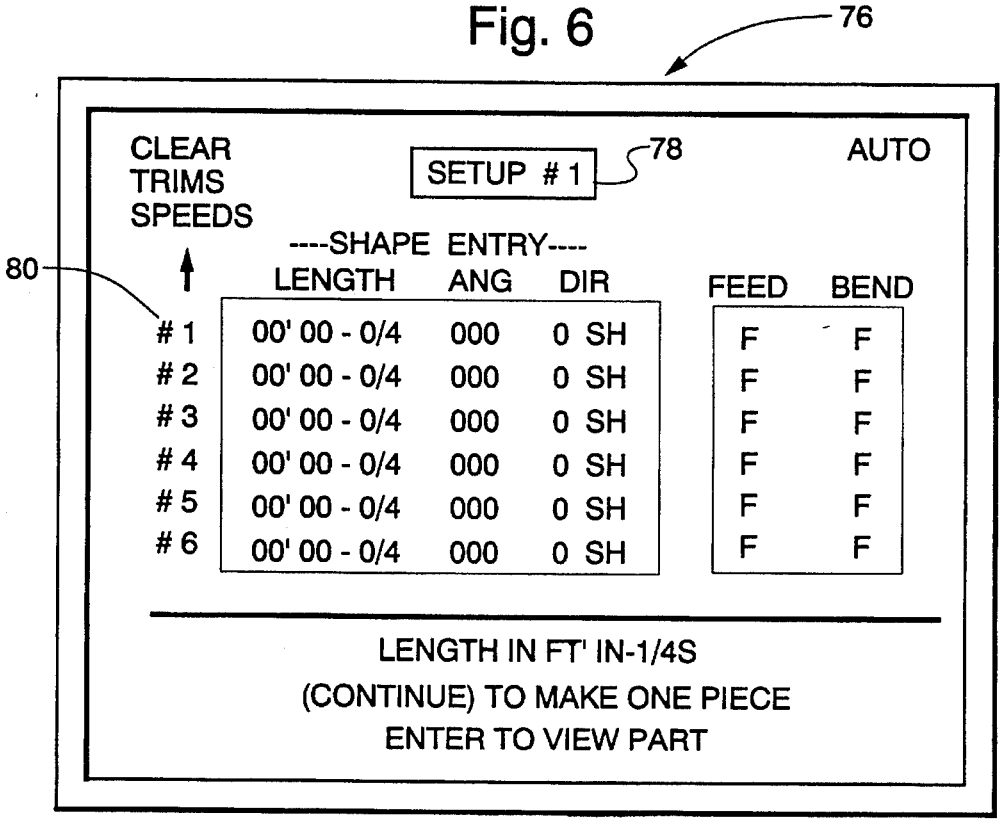
FIG. 6 is the optimizing controller screen display for the first production piece setup input for the manual setup mode.
Figure 7:
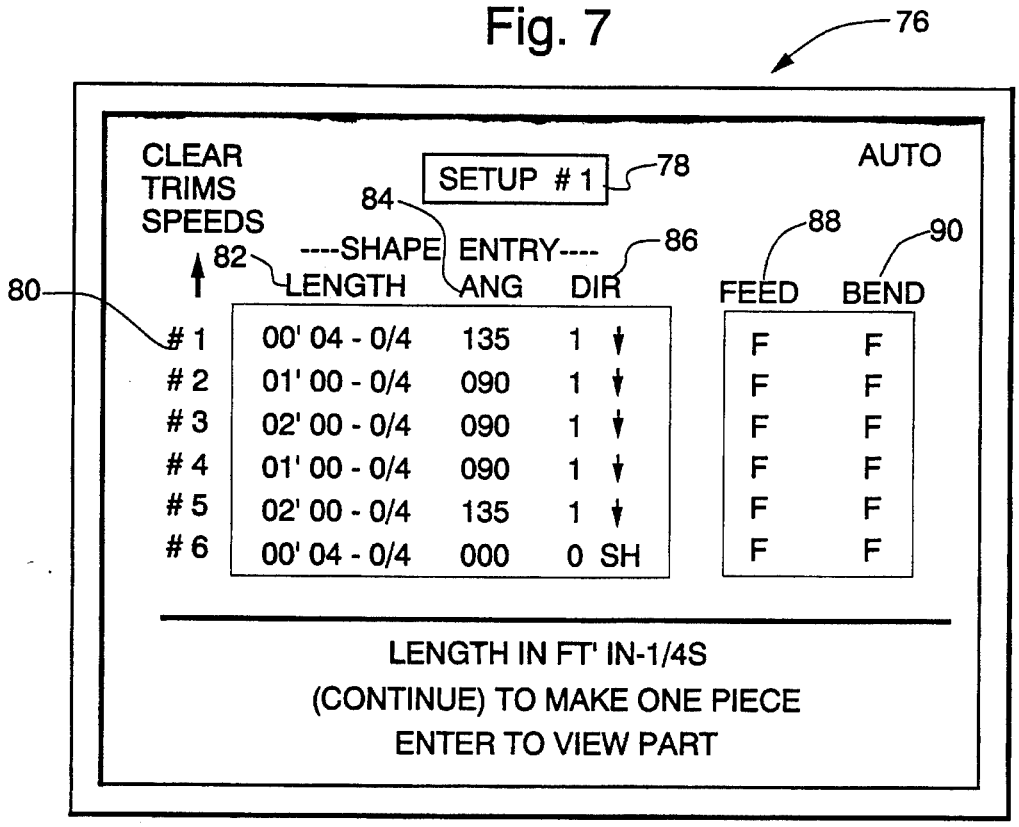
FIG. 7 is the optimizing controller screen display showing entry of the first production piece setup input data for the manual setup mode.

Directing attention now to FIG. 6 and the various components of production piece input data necessary for setting up the first production piece 78. The sequential bend number column 80, having #1 through #6, identifies the sequential bends by number in the progression from beginning to end to fabricate the first production piece 78 as shown in FIG. 8. The data entry lines respectively corresponding to each individual bend within the bend profile being number #1 through #6 within the sequential bend number column 80 provides for shape entry data input for each progressive bend in terms of first the length 82 of the subject sequential bend leg, second the angle 84 of bend in degrees of the subject sequential bend leg, and the direction 86 of bend of the subject sequential bend leg wherein 1 is down and 2 is up and 0 is to cut or shear. Lastly, for each of the subject sequential bend legs the operator enters the feed 88 and bend 90 speeds respectively for infeed of the straight rod stock bar 18 and execution of that bend to form each of the subject sequential bend legs wherein F is for fast and S is for slow and assignment of the feed 88 and bend 90 speeds would depend upon the handling and bending characteristics of the particular run of straight rod stock bar 18 being handled and processed.

When data input has been completed for the first production piece 78, being setup #1, the operator then presses enter key 48 in order to present the part view screen 92, whereon a visual profile of the first production piece 78 is shown along with the total segmental length of that portion of the overall 60-foot straight rod stock bar 18 which will be required in order to produce each individual first production piece 78 profile as shown on the part view screen 92, which in this exemplary case is "06 '04–¾", being 6-feet 4 and ¾-inches.

With the stirrup bender 12 of instant exemplary consideration, as was previously stated, it is known that the minimum tail piece wastage 32 that can be accommodated consistent with the stirrup bender tail piece handling capabilities, is eight-inches. It is also known that as a practical optimum operational reality, one attempts to come reasonably close to the minimum tail piece wastage 32 in achieving optimum operational run conditions. In the case of the first production piece 78 then, requiring a segmental length each of 6-feet 4 and ¾-inches from a 60-foot straight rod stock bar 18, that a total of 6 such first production piece 78 profiles with a tail wastage of 2.44-feet could be run. And, if the subject exemplary straight rod stock processing stirrup bender 12 were not equipped with the optimizing controller 10 of instant invention, in order to provide the capability for a production method enabling a combination of bent rod stock profiles in multiple counts to be processed and delivered from each individual infed straight rod stock bar 18, whereby bent rod stock piece output is optimized through such an output combination so as to most efficiently utilize the available stock from each such infed straight rod stock bar 18 and thereby consistently minimize the tail piece wastage 32 consistent with the stirrup bender 12 tail piece handling capabilities, then the tail piece wastage otherwise consigned to exemplary operational production of the first production piece 78 from each 60-foot infed length of straight rod stock bar 18 would be 2.44-feet. However, since the multiple count of multiple production piece profile operational run capability exists, and since the practical optimum operational run condition consistent with the minimum tail piece wastage 32 handling capability of the present exemplary stirrup bender 12 is reasonably 1-foot, the operator in attempting to more closely approximate the 1-foot tail piece wastage 32 objective would enter the setup data for the next two production pieces and by a combination of count and production piece profile mix more closely approach or reasonably reach that optimized tail piece wastage 32 objective, consistent with production schedules, by the multiple count of multiple production piece profile operational run method hereof.

Figure 9:
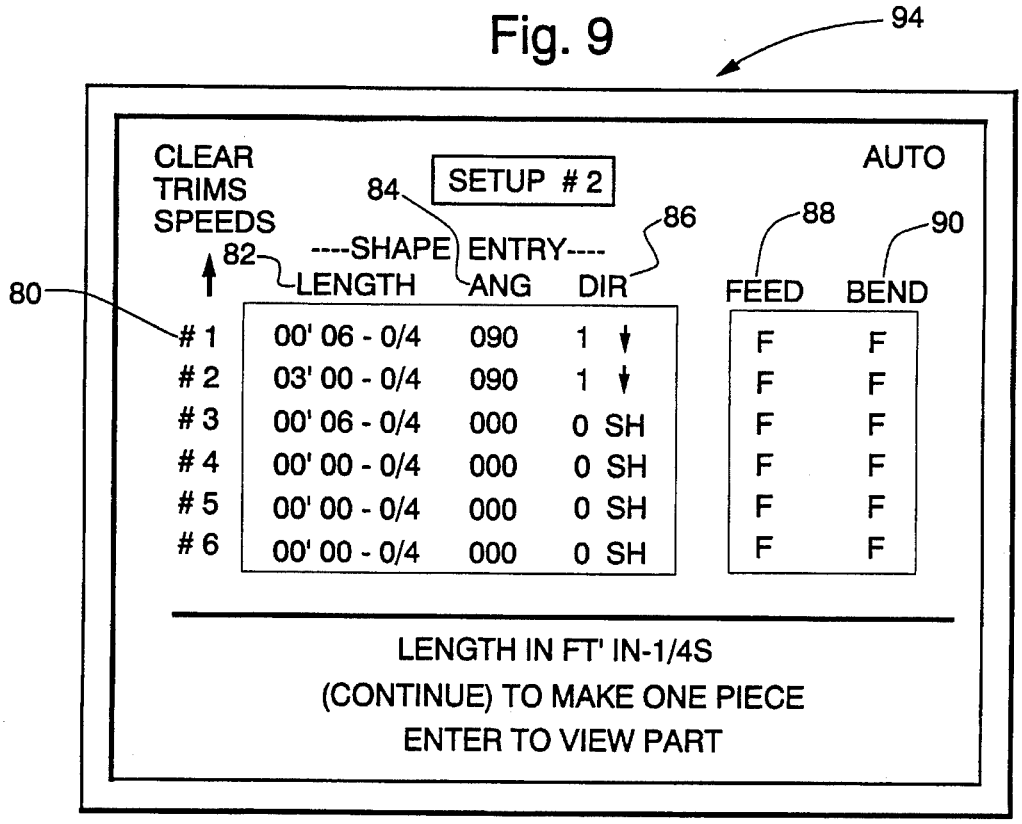
FIG. 9 is the optimizing controller screen display showing entry of the second production piece setup input data for the manual setup mode.
Figure 10:
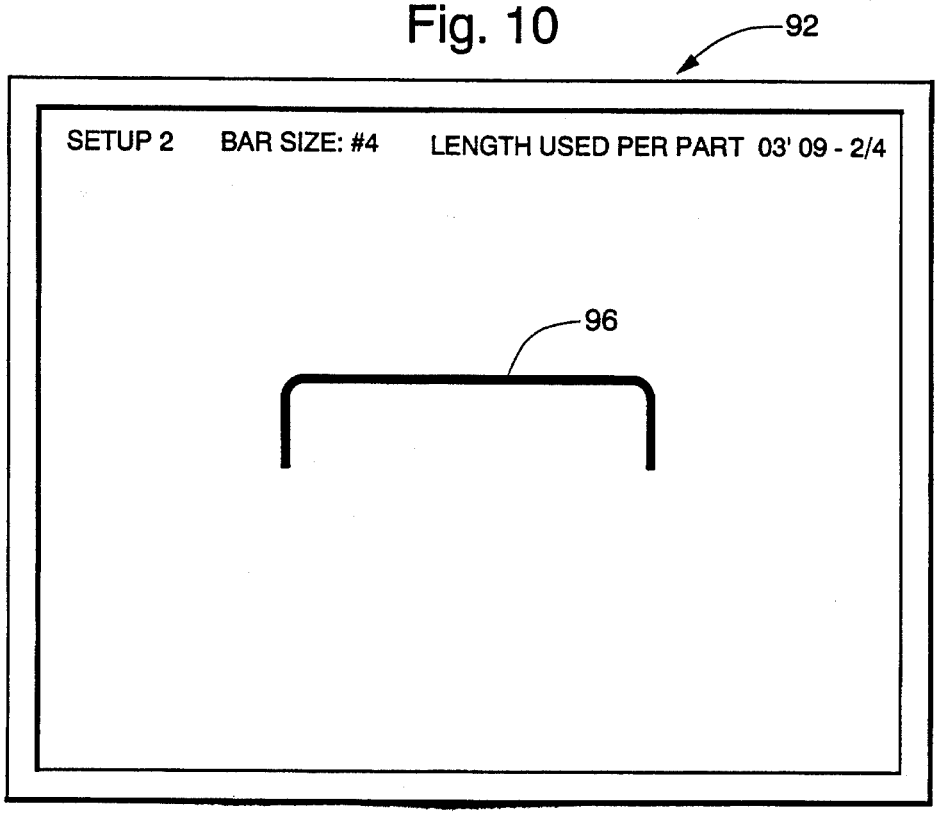
FIG. 10 is the optimizing controller screen display showing a profile projection of the shape of the second production piece setup.

In accomplishing the foregoing, the operator would depress the escape key 50 to exit the part view screen 92 for the first production piece 78 and return to the run setup mode screen 62 as shown in FIG. 5, moving the cursur to the number 2 setup position within the setup column 64, the operator would then press the enter key 48 to pull up the second production piece setup screen 94 as shown in FIG. 9. By the procedure previously described the operator would then enter the run data for the second production piece 96 as shown in FIG. 9, and press the enter key 48 to pull up The part view screen 92 as shown in FIG. 10 to see the profile of the second production piece as therein shown. In the exemplary case of the second production piece 96, the segmental length of straight rod stock bar 18 required for each such piece 96 would be "03' 09 –¾" which is 3-feet 9 and ½-inches.

Figure 11:
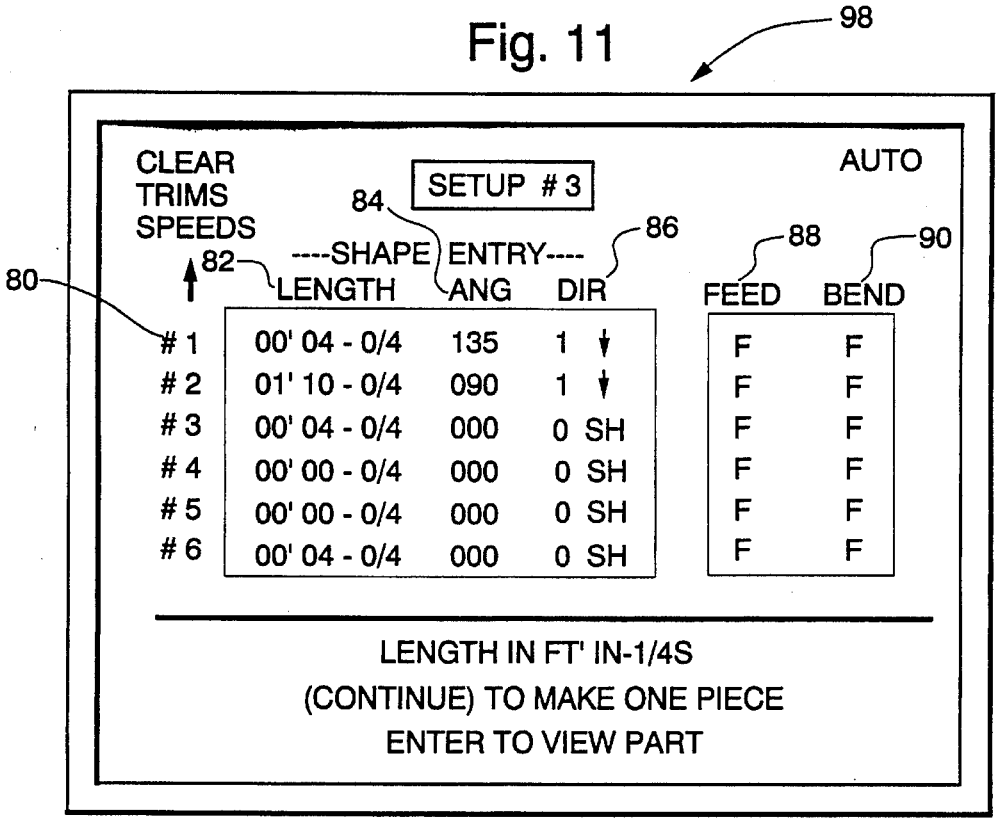
FIG. 11 is the optimizing controller display screen showing entry of the third production piece setup input data for the manual setup mode.
Figure 12:
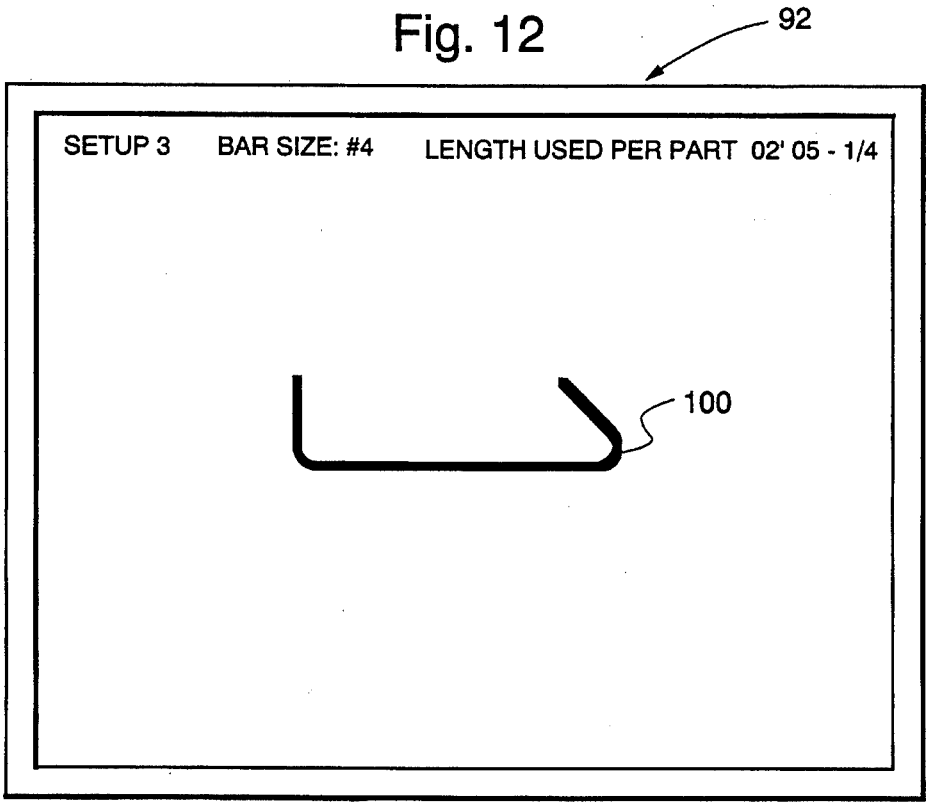
FIG. 12 is the optimizing controller screen display showing a profile projection of the shape of the third production piece setup.

In a like manner as above described the operator would depress the escape key 50 and return to the run setup mode screen 62, move the cursur to the number 3 setup position within the setup column 64, and press the enter key 48 to pull up the third production piece setup screen 98 as shown in FIG. 11. Again, by that procedure as previously described the operator would then enter the run data for the third production piece 100 as shown in FIG. 12, and press the enter key 48 to pull up the part view screen 92 as shown in FIG. 12 to see the profile of the third production piece 100 as therein shown. In the exemplary case of the third production piece 100, the segmental length of straight rod stock bar 18 required for each such piece 100 would be "02 05 –¼" which is 2-feet 5 and ¼-inches.

Figure 13:
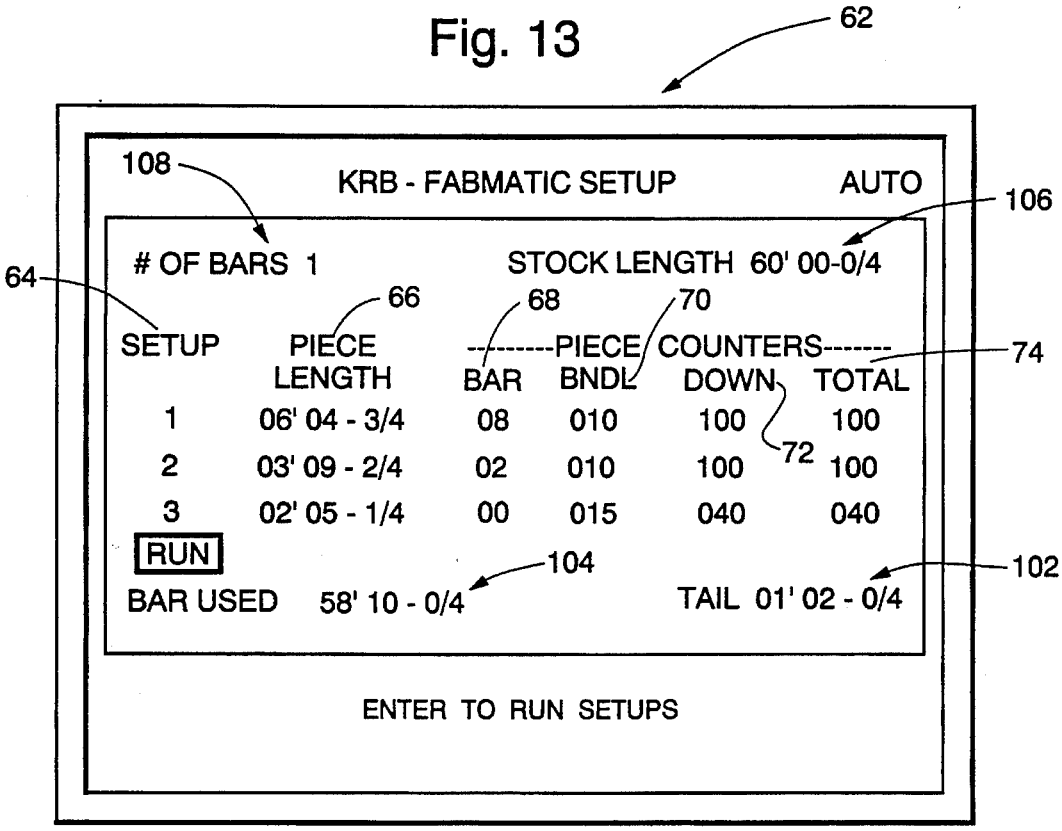
FIG. 13 is the optimizing controller run screen display showing the count combination for optimized production running of the first and second production piece profiles in order to minimize tail piece wastage.

Thus, with the three production piece 78, 96, and 100 setups entered as above described, the operator again presses the escape key 50 to return to the run setup mode screen 62 as shown in FIG. 13 to select and enter the count and profile combinations to be run in order to achieve the practical optimum operational condition of approximating 1-foot of tail piece wastage 32 which is closely consistent with the minimum tail piece wastage 32 handling capability of eight-inches for the present exemplary stirrup bender 12.

Figures 13A, 15A, 17A, 19A:
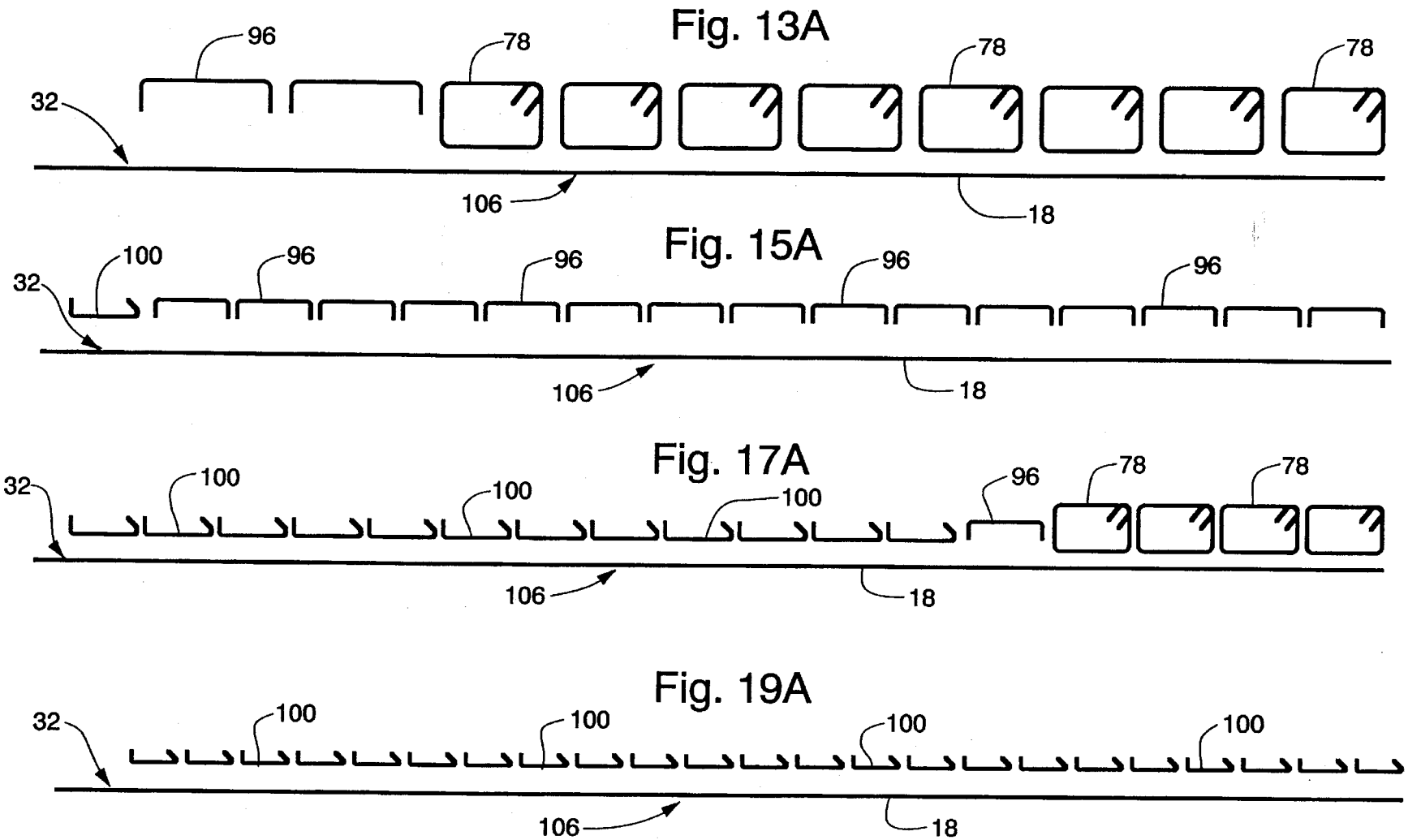
FIG. 13A shows a simplified diagrammatical illustration depicting the piece count and profile combination in relation to a piece of input stock for conversion in order to optimize production running of the first and second production piece profiles with minimized overall tail piece wastage.
FIG. 15A shows a simplified diagrammatical illustration depicting the piece count and profile combination in relation to a piece of input stock for conversion in order to optimize production running of the second and third production piece profiles with continued ongoing overall minimized tail piece wastage.
FIG. 17A shows a simplified diagrammatical illustration depicting the piece count and profile combination in relation to a piece of input stock for conversion in order to optimize continued production running of the third production piece profile and complete the production running of the first and second production piece profiles with continued ongoing overall minimized tail piece wastage.
FIG. 19A shows a simplified diagrammatical illustration depicting the piece count and profile array in relation to a piece of input stock for conversion in order to complete production running of the third piece profile.

By the simple process of changing the bar 68 count in combination with respect to the number of production pieces of each piece in the setup column 64 to be made, and checking the resultant tail readout 102 as it automatically appears with each such count combination change, so that the count combination set yields a tail piece 32 as shown in FIG. 13A reasonably near a 1-foot dimension, which in the case of a combined 8-count setting for the first production piece 78 and a 2-count setting for the second production piece 96 yields a resultant tail readout of "01' 02–¾" which is "1-foot 2-inches" and as a reasonable and practical run option is closely consistent with the minimum tail piece wastage handling capability for the present exemplary stirrup bender 12. It will be noted that out of the exemplary 60-foot straight rod stock bar 18 being run, the total bar used 104 is "58' 10–04" which is "58-feet 10-inches". At this point the operator would move the cursur to "RUN" and press the enter key 48 to effect automatic production of 8 first production pieces 78 and 2 second production pieces 96 from each of the infed 60-foot straight rod stock bars 18. After the production running of 12 such 60-foot straight rod stock bars 18 the run setup mode screen 62 would reflect the down counts 72 as shown in FIG. 14, being a remainder of 4 first production pieces 78 and 76 second production pieces 96 remaining to be made in order to complete the respective 100 count orders.

At this point the operator reassesses the remaining pieces to be made in completion of setup 1 and 2 orders in light of the setup 3 order of 40 pieces, and resets the bar 68 counts for that production piece combination which will enable recommencement of production closely consistent with the minimum tail piece wastage handling capability for the present exemplary stirrup bender 12, wherein it will be noted as shown in FIG. 15 the straight rod stock bar 18 stock length 106 continues to be 60-feet and the number of bars to be run at a time remains one-up as opposed to a two-up run as would be with the two-up set of secondary rod stock compression rollers 26B previously illustrated in FIG. 2B. With the bar 68 piece count reset as shown in FIG. 15 to produce 15 pieces of setup 1 and 1 piece of setup 3 per 60-foot infed straight rod stock bar 18, the amount of bar 18 used in production would be a total 104 of 59-feet 3 and ¾-inches with a tail piece wastage 32 of 8 and ¼-inches as shown by the resultant tail readout 102 all of which is diagrammatically illustrated in FIG. 15A.

Following the infeed and running of five 60-foot straight rod stock bars 18 as shown in FIG. 16, the operator is again at a point to reassess the remaining pieces to be made in completion of the setup 1 –3 orders, and with the bar 68 count settings as shown in FIG. 17 to automatically yield the piece production count as diagrammatically illustrated in FIG. 17A, on the infeed of one 60-foot straight rod stock bar 18 with a 1-foot 4 and ½-inch tail piece wastage 32 as shown by the resultant tail readout 102, setup 1 and 2 order counts will be completed and there will be 23 pieces remaining to be made to complete setup 3, all as shown in the FIG. 18 run setup mode screen 62 illustration.

At this point it should be reemphasized that the three setup examples herein described and discussed, although for illustrative purposes, are typical of actual production run mixes which could reasonably be anticipated in daily use of the optimizing controller 10 and the beneficial method of employment thereof in achieving production closely consistent with the minimum tail piece wastage handling capability of the particular exemplary stirrup bender 12 with which it may be utilized. It is also to be understood, as previously recited, that the three exemplary setups as herein discussed and described would only represent a small portion of the daily production capacity and capability of the optimizing controller driven stirrup bender machine center. Thus, as will be seen with the 3-foot 11 and ¼-inch tail piece wastage amount remaining upon completion of setup 3, as shown in FIGS. 19 and 20 and diagrammatically illustrated in FIG. 19A, this would be a typical tail piece wastage amount for the last of a shift or day's runs, and a tail piece wastage of this magnitude would be on a one-time per shift or day's basis presuming that setup 3 would be the last run, unless, of course, the setup 3 run could be mix counted in with the next shift per day's production and thereby maintain the resultant tail piece wastage more reasonably close to that of the 1-foot optimized tail piece 32 objective, consistent with production schedules, by the multiple production piece profile operational run method hereof.

Figure 20:
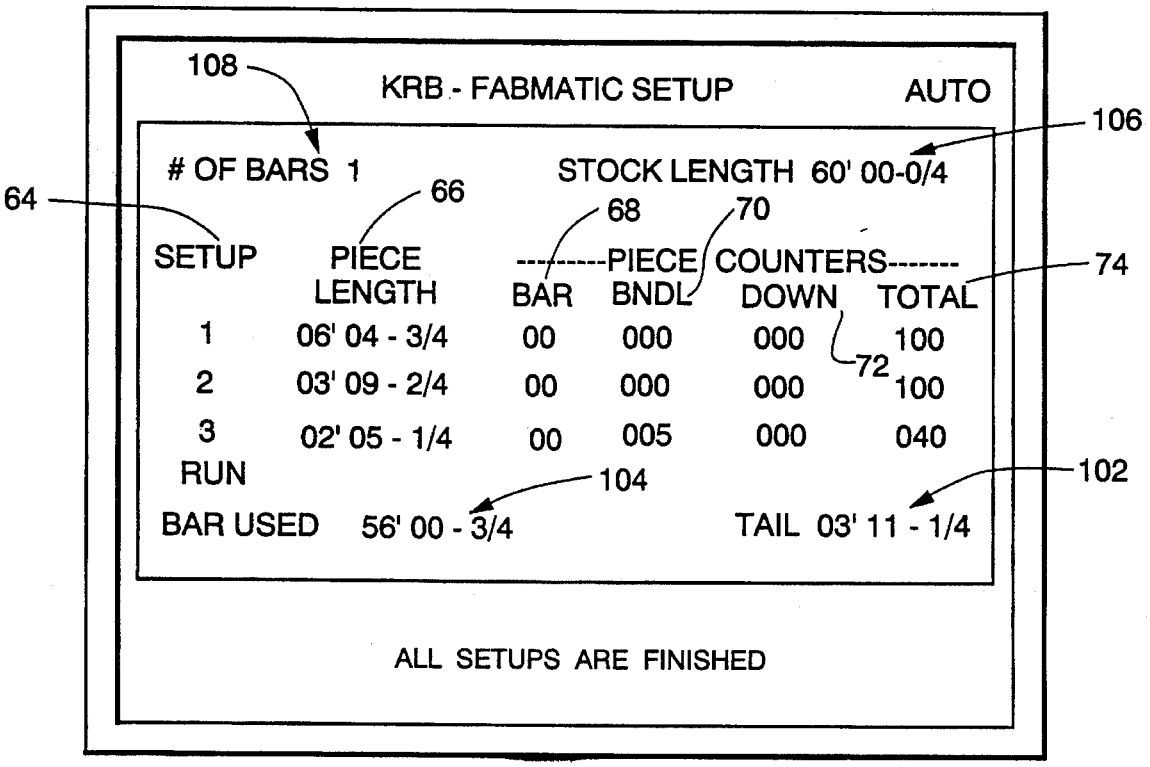
FIG. 20 is the optimizing controller run screen display showing the completion of the optimized production of production piece profiles one through three in the ordered quantities.

Referring to FIG. 20, after 1 straight rod stock bar 18 has been run, all the setups would then be completed.

It should again be emphasized, that although the structural, functional, and operational details of the exemplary stirrup bender 12, and the method of employment thereof in combination with the optimizing controller 10 has been shown and explained in what is conceived to be the most practical and preferred operational manner in most beneficially achieving production closely consistent with the minimum tail piece wastage handling capability of that subject stirrup bender 12 with which the optimizing controller 10 is exemplary shown in utilization, it is also to be recognized that departures may be made from the method hereof within the scope of the invention which is not to be limited to the specific details disclosed herein but is to be accorded the full scope of the claims so as to embrace any and all equivalent apparatus combinations and methods, and it is understood that such variations may be made within the scope of the appended claims.

I claim:

1. An optimizing controller operationally interfaced through a cable means in electronically connected combination with a stirrup bending machine to form an infed straight rod stock bar into various bent rod stock piece output profile shapes, and a computer program means in said controller adapted to drive said stirrup bender whereby a combination of different individual bent rod stock profile product output pieces in multiple counts may be delivered from each of said infed rod stock bars to thereby cumulatively utilize the linearly dimension of said straight rod stock bars closely consistent with the minimum tail piece wastage capability of said stirrup bending machine in the production utilization thereof for delivery of bent profile shapes from each of such infed rod stock bars and thereby minimize the stirrup bender tail piece wastage consistent with the stirrup bender minimum dimensional tail piece handling capabilities.

2. An optimizing controller according to claim 1 wherein said stirrup bender is provided with a set of 1-up secondary rod stock bar compression rollers.

3. An optimizing controller according to claim 1 wherein said stirrup bender is provided with a set of 2-up secondary rod stock bar compression rollers.

4. An optimizing controller according to claim 1 wherein said controller is setup by manual input means.

5. An optimizing controller according to claim 1 wherein said controller is setup by computer download means.

6. A computerized controller method for optimizing production utility of straight rod stock bars infed to a stirrup bending machine, comprising; setting up a computerized controller drive for the stirrup bender by entering a plurality of individual bent profile product output piece input data setups for the computer driven production respectively thereof; setting the lineal dimension of an infed straight rod stock bar for that dimension of infed rod stock bar to be run; setting a combination count of different individual bent profile product output pieces from the respective individual setups entered so as to achieve output production from said stirrup bender in cumulatively utilizing the lineal dimension of said straight rod stock bars closely consistent with the minimum tail piece wastage handling capability of the particular stirrup bender with which the optimizing method hereof is being employed.

7. A computerized controller method according to claim 6 wherein the setup is by manual input means.

8. A computerized controller method according to claim 6 wherein the setup is by computer download means.

* * * * *